US012291802B2

(12) United States Patent
Kim et al.

(10) Patent No.: US 12,291,802 B2
(45) Date of Patent: May 6, 2025

(54) POLYETHYLENE YARN, METHOD FOR MANUFACTURING THE SAME, AND SKIN COOLING FABRIC COMPRISING THE SAME

(71) Applicant: KOLON INDUSTRIES, INC., Seoul (KR)

(72) Inventors: Jae-Hyung Kim, Seoul (KR); Gi-Woong Kim, Seoul (KR); Seong-Young Kim, Seoul (KR); Sang-Mok Lee, Seoul (KR); Sin-Ho Lee, Seoul (KR); Young-Soo Lee, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 761 days.

(21) Appl. No.: 17/602,704

(22) PCT Filed: Dec. 27, 2019

(86) PCT No.: PCT/KR2019/018558

§ 371 (c)(1),
(2) Date: Oct. 8, 2021

(87) PCT Pub. No.: WO2021/132768

PCT Pub. Date: Jul. 1, 2021

(65) Prior Publication Data

US 2022/0205145 A1 Jun. 30, 2022

(51) Int. Cl.

| | |
|---|---|
| ***D02G 3/44*** | (2006.01) |
| ***D01D 5/088*** | (2006.01) |
| ***D01F 6/04*** | (2006.01) |

(52) U.S. Cl.

CPC ..... *D02G 3/44* (2013.01); *D01D 5/088* (2013.01); *D01F 6/04* (2013.01); *D10B 2321/021* (2013.01)

(58) Field of Classification Search

None

See application file for complete search history.

(56) References Cited

U.S. PATENT DOCUMENTS 4,228,118 A 10/1980 Wu
4,287,149 A 9/1981 Capaccio
(Continued)

FOREIGN PATENT DOCUMENTS

CN 102002769 A 4/2011
CN 103469345 A 12/2013
(Continued)

OTHER PUBLICATIONS

Omnexus. "Density of Plastics: Technical Properties." Online: https://omnexus.specialchem.com/polymer-property/density (Year: 2024).*
(Continued)

*Primary Examiner* — Lynda Salvatore

(74) *Attorney, Agent, or Firm* — Harvest IP Law, LLP

(57) ABSTRACT

Disclosed is a polyethylene yarn capable of providing a user with a soft tactile sensation as well as a cooling feeling or a cooling sensation, and also having improved weavability that enables the manufacture of a skin cooling fabrics having excellent pilling resistance, abrasion resistance, cuttability, and sewability, a method for manufacturing the same, and a skin cooling fabric including the same. In a strength-elongation curve of the polyethylene yarn obtained by measuring at ambient temperature, (i) elongation at strength of 1 g/d is 0.5 to 3%, (ii) elongation at strength of 3 g/d is 5.5 to 10%, and (iii) a difference between elongation at strength of 4 g/d and elongation at maximum strength is 5.5 to 25%, and the polyethylene yarn has toughness of 55 to 120 J/m$^3$ at ambient temperature.

8 Claims, 3 Drawing Sheets

(56) References Cited

U.S. PATENT DOCUMENTS

| | | | | |
|---|---|---|---|---|
| 4,778,633 | A * | 10/1988 | Kiang | D06M 10/001 264/479 |
| 2011/0092937 | A1 | 4/2011 | Pepper | |
| 2011/0300366 | A1* | 12/2011 | Henssen | D02G 3/36 442/310 |
| 2014/0000007 | A1 | 1/2014 | Fukushima | |
| 2016/0017518 | A1 | 1/2016 | Lorenzo | |
| 2018/0016710 | A1 | 1/2018 | Tam | |

FOREIGN PATENT DOCUMENTS

| | | | |
|---|---|---|---|
| CN | 104271819 | A | 1/2015 |
| CN | 109385689 | A | 2/2019 |
| EP | 0055001 | B1 | 4/1985 |
| JP | S5077479 | A | 6/1975 |
| JP | S57128213 | A | 8/1982 |
| JP | S63135512 | A | 6/1988 |
| JP | S63-165120 | A | 7/1988 |
| JP | H06239934 | A | 8/1994 |
| JP | H10266056 | A | 10/1998 |
| JP | 2000265324 | A | 9/2000 |
| JP | 2002266206 | A | 9/2002 |
| JP | 2003049320 | A | 2/2003 |
| JP | 2004292982 | A | 10/2004 |
| JP | 4227837 | B2 | 12/2008 |
| JP | 2009024272 | A | 2/2009 |
| JP | 2010236130 | A | 10/2010 |
| JP | 2012526175 | A | 10/2012 |
| JP | 2013545901 | A | 12/2013 |
| JP | 2015071840 | A | 4/2015 |
| JP | 2015089980 | A | 5/2015 |
| JP | 2017066584 | A | 4/2017 |
| JP | 2019501989 | A | 1/2019 |
| JP | 2019031755 | A | 2/2019 |
| KR | 1020050003118 | A | 1/2005 |
| KR | 10-2010-0021961 | A | 2/2010 |
| KR | 1020110089404 | A | 8/2011 |
| KR | 1020130018676 | A | 2/2013 |
| KR | 10-2016-0056653 | A | 5/2016 |
| KR | 10-2016-0082512 | A | 7/2016 |
| KR | 10-2017-0037392 | A | 4/2017 |
| KR | 1020170135342 | A | 12/2017 |
| KR | 10-1858242 | B1 | 5/2018 |
| KR | 10-2018-0120373 | A | 11/2018 |
| KR | 10-1981760 | B1 | 5/2019 |
| KR | 101992444 | B1 | 6/2019 |
| KR | 1020200036171 | A | 4/2020 |
| TW | 369576 | B | 9/1999 |
| TW | 201919555 | A | 6/2019 |
| WO | 2002048436 | A1 | 6/2002 |
| WO | 2011135860 | A1 | 11/2011 |
| WO | 2013168543 | A1 | 11/2013 |
| WO | 2016089311 | A1 | 6/2016 |

OTHER PUBLICATIONS

The European Search Report dated Mar. 30, 2023.
The CN Office Action dated Aug. 26, 2022.
International Search Report dated Sep. 22, 2020.
Search Report of the corresponding Taiwanese Patent Application No. 108148142.

* cited by examiner

【FIG. 1】
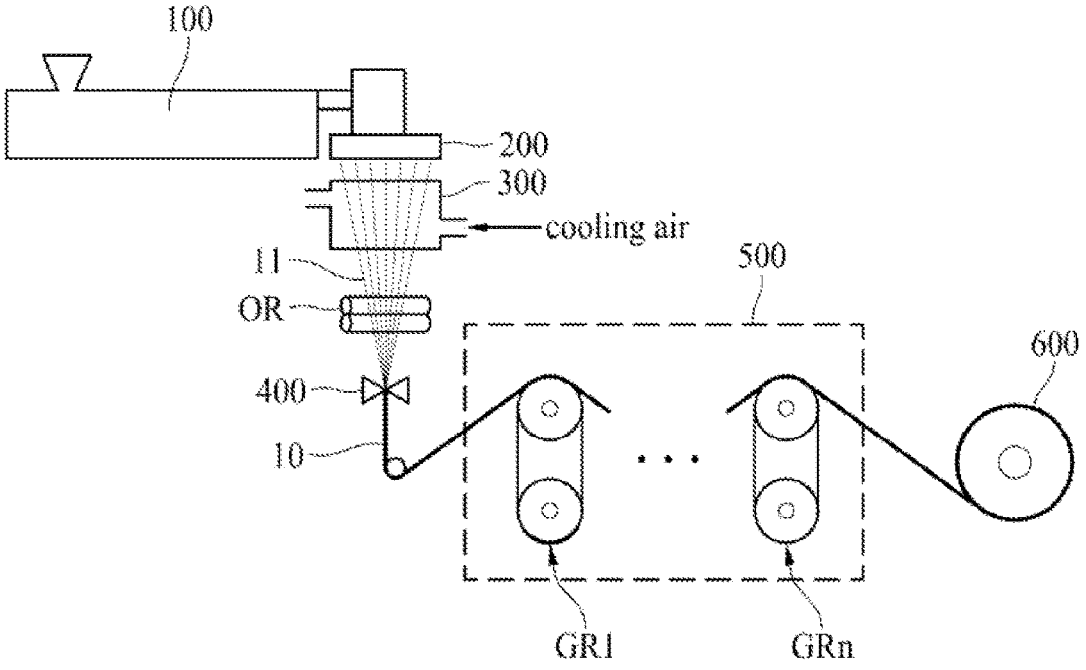

【FIG. 2】
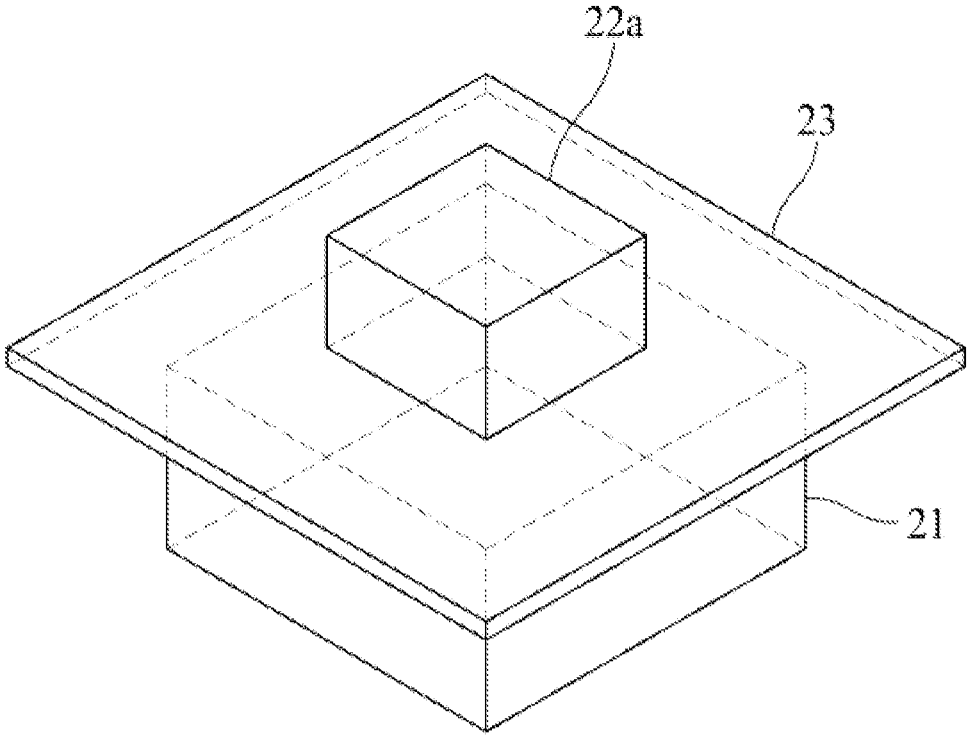

【FIG. 3】
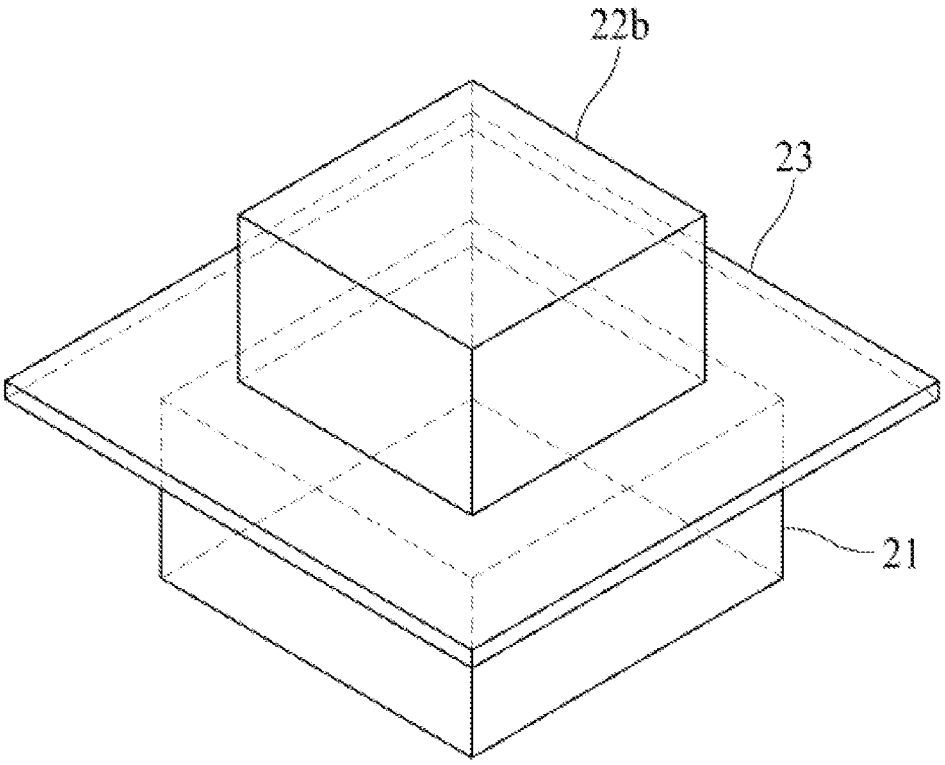

POLYETHYLENE YARN, METHOD FOR MANUFACTURING THE SAME, AND SKIN COOLING FABRIC COMPRISING THE SAME

CROSS REFERENCE TO RELATED APPLICATIONS

This application is a National Stage of International Application No. PCT/KR2019/018558 filed Dec. 27, 2019.

TECHNICAL FIELD

The present invention relates to a polyethylene yarn, a method for manufacturing the same, and a skin cooling fabric including the same. More particularly, the present invention relates to a polyethylene yarn capable of providing a user with a soft tactile sensation as well as a cooling feeling or a cooling sensation, and also having improved weavability that enables the manufacture of a skin cooling fabric having excellent pilling resistance, abrasion resistance, cuttability, and sewability, a method for manufacturing the same, and a skin cooling fabric including the same.

BACKGROUND ART

As global warming progresses, there is an increasing need for fabrics that can be used to overcome intense heat. Factors that can be considered in developing fabrics that can be used to overcome the intense heat include (i) removal of factors that cause intense heat and (ii) removal of heat from the user's skin.

A method focused on the removal of factors of intense heat, a method of reflecting light by applying an inorganic compound to the surface of the fiber (for example, see JP 4227837B), a method of scattering light by dispersing inorganic fine particles inside and on the surface of the fiber (for example, see JP 2004-292982A), and the like have been proposed. However, blocking these external factors can only prevent additional intense heat, and for users who already feel heat, there is a limit that not only can it not be a significant solution, but also the tactile sensation of the fabric is degraded.

On the other hand, as a method capable of removing heat from a user's skin, a method of improving moisture absorption of the fabric in order to utilize the heat of evaporation of sweat (for example, see JP 2002-266206A), a method of increasing a contact area between the skin and the fabric in order to increase the heat transfer from the skin to the fabric (for example, see JP 2009-24272A), and the like have been proposed.

However, in the case of using the evaporation heat of sweat, since the function of the fabric depends greatly on external factors such as humidity or the user's constitution, there is a problem that its consistency cannot be guaranteed. In the case of a method of increasing the contact area between the skin and the fabric, as the contact area increases, the air permeability of the fabric decreases, so that many cooling effects that the user wants cannot be obtained.

Thus, it may be desirable to increase heat transfer from the skin to the fabric by improving the thermal conductivity of the fabric itself. To achieve this purpose, JP 2010-236130A proposes manufacturing fabrics using ultra-high strength polyethylene fibers (Dyneema® SK60) having high thermal conductivity.

However, Dyneema® SK60 fiber used in JP 2010-236130A is an Ultra High Molecular Weight Polyethylene (UHMWPE) fiber having a weight average molecular weight of 600,000 g/mol or more. Even if it exhibits high thermal conductivity, since it can be produced only by a gel spinning method due to the high melt viscosity of UHMWPE, there is a problem that environmental problems are caused and considerable costs are required to recover the organic solvent. Further, since Dyneema® SK60 fiber has high strength of 28 g/d or more, a high tensile modulus of 759 g/d or more, and a low elongation at break of 3 to 4%, and the elongation at a strength of 1 g/d in the strength-elongation curve is less than 0.5%, the weavability is not good and the stiffness is too high, and thus it is unsuitable for use in the manufacture of skin cooling fabrics that are intended for contacting with the user's skin. In addition, since Dyneema® SK60 fiber has high toughness of more than 120 J/m$^3$, there is a problem that the cutability and sewability of the fabric manufactured by using this are reduced.

DETAILED DESCRIPTION OF THE PRESENT DISCLOSURE

Technical Problem

Therefore, the present invention is directed to providing a polyethylene yarn that can prevent one or more of the problems due to limitations and disadvantages of the related arts, a method for manufacturing the same, and a skin cooling fabric including the same.

An aspect of the present invention is to provide a polyethylene yarn capable of providing a user with a soft tactile sensation as well as a cooling feeling or a cooling sensation, and having improved weavability that enables the manufacture of a skin cooling fabrics having excellent pilling resistance, abrasion resistance, cuttability, and sewability.

Another aspect of the present invention is to provide a method for manufacturing a polyethylene yarn capable of providing a user with a soft tactile sensation as well as a cooling feeling or a cooling sensation, and also having improved weavability that enables the manufacture of a skin cooling fabrics having excellent pilling resistance, abrasion resistance, cuttability, and sewability.

Yet another aspect of the present invention is to provide a fabric capable of providing a user with a soft tactile sensation as well as a cooling feeling or a cooling sensation, and also having excellent pilling resistance, abrasion resistance, cuttability and sewability.

Additional advantages, objects, and features of the invention will be set forth in part in the description which follows and in part will become apparent to those having ordinary skill in the art upon examination of the following or may be learned from practice of the invention.

Technical Solution

In accordance with one aspect of the present invention as described above, a polyethylene yarn is provided, wherein in a strength-elongation curve of the polyethylene yarn obtained by measuring at ambient temperature, (i) elongation at strength of 1 g/d is 0.5 to 3%, (ii) elongation at strength of 3 g/d is 5.5 to 10%, and (iii) a difference between elongation at strength of 4 g/d and elongation at maximum strength is 5.5 to 25%, and wherein the polyethylene yarn has toughness of 55 to 120 J/m$^3$ at ambient temperature.

The polyethylene yarn may have tensile strength of more than 4 g/d and 6 g/d or less, a tensile modulus of 15 to 80 g/d, elongation at break of 14 to 55%, and crystallinity of 60 to 85%.

The polyethylene yarn may have a weight average molecular weight (Mw) of 50,000 to 99,000 g/mol and a polydispersity index (PDI) of 5 to 9.

The polyethylene yarn may have total fineness of 75 to 450 denier, and the polyethylene yarn may include a plurality of filaments each having fineness of 1 to 5 denier.

The polyethylene yarn may have a circular cross-section.

In accordance with another aspect of the present invention, a skin cooling fabric formed of the polyethylene yarn is provided, wherein the skin cooling fabric at 20° C. has thermal conductivity in the thickness direction of 0.0001 W/cm ° C. or more, a heat transfer coefficient in the thickness direction of 0.001 W/cm$^2$° C. or more, and a contact cold sensation ($Q_{max}$) of 0.1 W/cm$^2$ or more.

Pilling resistance of the skin cooling fabric measured according to ASTM D 4970-07 may be grade 4 or higher, and abrasion resistance of the skin cooling fabric measured according to the Martindale method as specified in KS K ISO 12947-2:2014 may be 5000 cycles or more.

The area density of the skin cooling fabric may be 75 to 800 g/m$^3$.

In accordance with another aspect of the present invention, a method for manufacturing a polyethylene yarn is provided, including the steps of:

melting a polyethylene having a density of 0.941 to 0.965 g/cm$^3$, a weight average molecular weight (Mw) of 50,000 to 99,000 g/mol, a polydispersity index (PDI) of 5.5 to 9, and a melt index (MI) (at 190° C.) of 6 to 21 g/10 min, extruding the molten polyethylene through a spinneret having a plurality of spinning holes;

cooling a plurality of filaments formed when the molten polyethylene is discharged from the holes of the spinneret; and drawing a multifilament composed of the cooled filaments.

The drawing step may be performed at a draw ratio of 2.5 to 8.5.

The general description related to the present invention given above is intended only to illustrate or disclose the present invention and should not be construed as limiting the scope of the present invention.

Advantageous Effects

The polyethylene yarn for a skin cooling fabric of the present invention has high thermal conductivity, toughness adjusted to an appropriate range, and excellent weavability, and can be easily manufactured at a relatively low cost without causing environmental problems.

In addition, the skin cooling fabric woven from the polyethylene yarn of the present invention (i) can consistently provide a user with a cooling sensation regardless of external factors such as humidity, (ii) can continuously provide a user with a sufficient cooling sensation without sacrificing air permeability, (iii) can provide a soft tactile sensation to a user, (iv) can improve the durability of the final product by having high pilling resistance and abrasion resistance, and (v) can improve productivity of the final product by having excellent cuttability and sewability.

BRIEF DESCRIPTION OF DRAWINGS

The accompanying drawings, which are included to provide further understanding of the invention and are incorporated in and constitute a part of this application, illustrate embodiment(s) of the invention, and together with the description serve to explain the principle of the invention.

FIG. 1 schematically shows an apparatus for manufacturing a polyethylene yarn according to an embodiment of the present invention.

FIG. 2 schematically shows an apparatus for measuring the contact cold sensation ($Q_{max}$) of a skin cooling fabric.

FIG. 3 schematically shows an apparatus for measuring the thermal conductivity and heat transfer coefficient in the thickness direction of the skin cooling fabric.

DETAILED DESCRIPTION OF THE EMBODIMENTS

Hereinafter, embodiments according to the present invention will be described in detail with reference to the accompanying figures. However, the embodiments described below are provided for illustrative purposes only to help clear understanding of the present invention and should not be construed as limiting the scope of the present invention.

In order to make the user feel a sufficient cooling sensation, the yarns used in the manufacture of the skin cooling fabric are preferably polymer yarns having high thermal conductivity.

In the case of a solid, heat is generally transferred through the movement of free electrons and lattice vibrations called "phonon". In the case of a metal, heat is transferred in the solid mainly by the movement of free electrons. In contrast, in the case of nonmetallic materials such as polymers, heat is mainly transferred through the phonon within the solid (especially in the direction of the molecular chains connected via covalent bonds).

In order to improve the thermal conductivity of the fabric so that the user can feel a cooling sensation, it is necessary to enhance the heat transfer capability through the phonon of the polymer yarn by increasing the crystallinity of the polymer yarn to 60% or more.

According to the present invention, in order to produce a polymer yarn having such high crystallinity, high density polyethylene (HDPE) is used. This is because yarns made from high density polyethylene (HDPE) having a density of 0.941 to 0.965 g/cm$^3$ have relatively high crystallinity as compared with yarns made from low density polyethylene (LDPE) having a density of 0.910 to 0.925 g/cm$^3$ and yarns made from linear low density polyethylene (LLDPE) having a density of 0.915 to 0.930 g/cm$^3$.

Meanwhile, the high density polyethylene (HDPE) yarn may be classified into an ultra high molecular weight polyethylene (UHMWPE) yarn and a high molecular weight polyethylene (HMWPE) yarn according to their weight average molecular weight (Mw). The UHMWPE generally refers to a linear polyethylene having a weight average molecular weight (Mw) of 600,000 g/mol or more, whereas the HMWPE generally refers to a linear polyethylene having a weight average molecular weight (Mw) of 20,000 to 250,000 g/mol.

As mentioned above, since UHMWPE yarns such as Dyneema® can only be produced by gel spinning due to the high melt viscosity of UHMWPE, there is a problem that environmental problems are caused and considerable costs are required to recover the organic solvent.

Since HMWPE has a relatively low melt viscosity compared to UHMWPE, melt spinning is possible, and as a result, environmental and high cost problems associated with UHMWPE yarns can be overcome. Therefore, the polyethylene yarn for a skin cooling fabric of the present invention is a yarn formed of HMWPE.

In the strength-elongation curve of the polyethylene yarn of the present invention obtained by measuring at ambient temperature, (i) "elongation at strength of 1 g/d" is 0.5 to 3%, (ii) "elongation at strength of 3 g/d" is 5.5 to 10%, and (iii) "a difference between elongation at strength of 4 g/d and elongation at maximum strength (i.e., tensile strength)" is 5.5 to 25%.

Further, the polyethylene yarn of the present invention has a toughness of 55 to 120 J/m$^3$ at ambient temperature.

If the "elongation at strength of 1 g/d" of the polyethylene yarn is too low, the fabric woven from the yarn becomes too stiff (i.e., the stiffness of the fabric is too high), causing a bad tactile sensation to the user. Therefore, it is preferable that the "elongation at strength of 1 g/d" of the polyethylene yarn is 0.5% or more.

However, if the "elongation at strength of 1 g/d" of the polyethylene yarn is too high, a phenomenon in which the yarn is stretched occurs during weaving of the fabric, which makes it difficult to adjust the density of the fabric to the required density. Therefore, the "elongation at strength of 1 g/d" of the polyethylene yarn is preferably 3% or less.

Specifically, the "elongation at strength of 1 g/d" of the polyethylene yarn may be 0.5to 3%, 1.0 to 3.0%, 1.0 to 2.0%, or 1.4 to 2.0%.

If the "elongation at strength of 3 g/d" of the polyethylene yarn is too low, there is a high risk of a yarn breakage occurring in the fabric weaving process to which a predetermined amount of tension is applied. Therefore, the "elongation at strength of 3 g/d" of the polyethylene yarn is preferably 5.5% or more.

However, if the "elongation at strength of 3 g/d" of the polyethylene yarn is too high, crimp is insufficiently expressed during weaving of the fabric, resulting in a fabric having low tear strength and low durability. Therefore, the "elongation at strength of 3 g/d" of the polyethylene yarn is preferably 10% or less.

Specifically, the "elongation at strength of 3 g/d" of the polyethylene yarn may be 5.5 to 10%, 6.0 to 9.0%, or 6.0 to 8.5%.

The toughness is an area between the strength-elongation curve (x-axis:elongation , y-axis:strength) and the x-axis (integral value), which has a tendency to increase as the "difference between elongation at strength of 4 g/d and elongation at maximum strength" increases.

If the "difference in elongation at 4 g/d strength and elongation at maximum strength" of the polyethylene yarn is too small or the toughness of the polyethylene yarn is too small, the pilling resistance and abrasion resistance of the fabric woven from the yarn is not satisfactory. That is, as the polyethylene yarn has "the difference between elongation at strength of 4 g/d and elongation at maximum strength" of 5.5% or more and toughness of 55 J/m$^3$ or more, the skin cooling fabric produced using this material has pilling resistance of grade 4 or higher (measured according to ASTM D 4970-07) and abrasion resistance of 5000 cycles or more (measured according to the Martindale method as specified in KS K ISO 12947-2:2014).

However, if the "difference between elongation at strength of 4 g/d and elongation at maximum strength" of the polyethylene yarn is too large or the toughness of the polyethylene yarn is too large, the cuttability and sewability of the fabric woven from the yarn is not good, and thus, the productivity of the final product is lowered. Furthermore, using expensive special cutting machines and sewing machines to overcome these problems leads to an increase in production costs. Therefore, the "difference between elongation at strength of 4 g/d and elongation at maximum strength" of the polyethylene yarn is preferably 25% or less. Further, the toughness of the polyethylene yarn is preferably 120 J/m$^3$ or less.

Specifically, the "difference between elongation at strength of 4 g/d and elongation at maximum strength" of the polyethylene yarn may be 5.5 to 25%, 9.0 to 20%, or 9.5 to 15%.

The polyethylene yarn may have a toughness of 55 to 120 J/m$^3$, or 60 to 100 J/m$^3$, or 65 to 95 J/m$^3$ at ambient temperature.

In addition, the polyethylene yarn according an embodiment of the present invention has tensile strength of 4 g/d or more and 6 g/d or less, a tensile modulus of 15 to 80 g/d, elongation at break of 14 to 55%, and crystallinity of 60 to 85%. Preferably, the polyethylene yarn has tensile strength of 4.5 g/d to 5.5 g/d, a tensile modulus of 40 to 60 g/d, elongation at break of 20 to 35%, and crystallinity of 70 to 80%.

If the tensile strength is more than 6 g/d, the tensile modulus is more than 80 g/d, or the elongation at break is less than 14%, not only is the weavability of the polyethylene yarn not good, but also the fabric produced using the yarn is excessively stiff, such that the user may feel discomfort. Conversely, if the tensile strength is 4 g/d or less, the tensile modulus is less than 15 g/d, or the elongation at break exceeds 55%, pills may form on fabrics and even breakage of the fabric occurs when the user continuously uses fabrics made from these polyethylene yarns.

If the crystallinity of the polyethylene yarn is less than 60%, its thermal conductivity is low, and thus the fabric made therefrom cannot provide the user with a sufficient cooling sensation. That is, since the polyethylene yarn has crystallinity of 60 to 85%, the skin cooling fabric produced using the same may have thermal conductivity in the thickness direction of 0.0001 W/cm ° C. or more, a heat transfer coefficient in the thickness direction of 0.001 W/cm$^3$° C. or more at 20° C., and a contact cold sensation ($Q_{max}$) of 0.1 W/cm$^3$ or more.

The polyethylene yarn according to an embodiment of the present invention has a weight average molecular weight (Mw) of 50,000 to 99,000 g/mol and a polydispersity index (PDI) of 5 to 9, or 5.5 to 7.0.

The polydispersity index (PDI) is the ratio (Mw/Mn) of the weight average molecular weight (Mw) to the number average molecular weight (Mn), which is also referred to as a molecular weight distribution index (MWD). The weight average molecular weight (Mw) and polydispersity index (PDI) of the polyethylene yarn are closely related to the physical properties of polyethylene used as a raw material.

The polyethylene yarn of the present invention may have a DPF (Denier Per Filament) of 1 to 5. That is, the polyethylene yarn may include a plurality of filaments each having fineness of 1 to 5 denier. In addition, the polyethylene yarn of the present invention may have total fineness of 75 to 450 denier.

In a polyethylene yarn having a predetermined total fineness, if the fineness of each filament exceeds 5 denier, the smoothness of the fabric made form the polyethylene yarn becomes insufficient and the contact area with the body becomes small, thus making it impossible to provide a user with sufficient cooling sensation. In general, the DPF can be adjusted through the discharge amount per hole of a spinneret (hereinafter, referred to as the "single-hole discharge amount") and the draw ratio.

The polyethylene yarn of the present invention may have a circular cross-section or a non-circular cross-section, but it is desirable to have a circular cross-section from the viewpoint that it can provide an uniform cooling sensation to the user.

The skin cooling fabric of the present invention made from the polyethylene yarn described above may be a woven or knitted fabric having a weight per unit area (i.e., area density) of 75 to 800 g/m$^2$. If the area density of the fabric is less than 75 g/m$^2$, the denseness of the fabric will be insufficient and there will be many voids in the fabric. These voids reduce the cooling sensation of the fabric. On the other hand, if the area density of the fabric exceeds 800 g/m$^2$, the fabric is very stiff due to the excessively dense fabric structure, causing a problem in the tactile sensation felt by the user, and the high weight causes a problem in use.

According to one embodiment of the present invention, the skin cooling fabric of the present invention may be a fabric having a cover factor of 400 to 2000 according to Equation 1 below.

$$CF=(W_D*W_T^{1/2})+(F_D*F_T^{1/2}) \quad \text{[Equation 1]}$$

In Equation 1, CF is a cover factor, $W_D$ is a warp density (ea/inch), $W_T$ is a weft fineness (denier), $F_D$ is a weft density (ea/inch), and $F_T$ is a weft fineness (denier).

If the cover factor is less than 400, there is a problem that the denseness of the fabric is insufficient, and the cooling sensation of the fabric is lowered due to too many voids existing in the fabric. On the other hand, if the cover factor is more than 2000, the denseness of the fabric is excessively high, the tactile sensation of the fabric becomes worse, and a problem in use can occur due to the high fabric weight.

The skin cooling fabric of the present invention has, at 20° C.:

(i) thermal conductivity in the thickness direction of 0.0001 W/cm ° C. or higher, or 0.0003 to 0.0005 W/cm ° C.;

(ii) a heat transfer coefficient in the thickness direction of 0.001 W/cd ° C. or higher, or 0.01 to 0.02 W/cd ° C.; and (iii) a contact cold sensation ($Q_{max}$) of 0.1 W/cm$^3$ or more, 0.1 to 0.3 IN/cm$^3$, or 0.1 to 0.2 IN/cm$^3$.

The measurement method of the thermal conductivity, heat transfer coefficient, and contact cold sensation ($Q_{max}$) of the fabric will be described below.

The pilling resistance of the skin cooling fabric of the present invention measured according to ASTM D 4970-07 is grade 4 or higher, and the abrasion resistance of the skin cooling fabric of the present invention measured according to the Martindale method as specified in KS K ISO 12947-2:2014 is 5000 cycles or more.

In order to manufacture polyethylene yarns having the above-mentioned strength-elongation properties, toughness, tensile strength, tensile modulus, elongation at break, and crystallinity, not only process factors such as (i) the spinning temperature, (ii) the LID of the spinneret, (iii) the discharge linear velocity from the spinneret of the molten polyethylene, (iv) the distance from the spinneret to the multistage drawing part [specifically, the first godet roller part of a multistage drawing part], (v) cooling conditions, (vi) spinning speed, etc., should be precisely controlled, but it is also necessary to select a raw material having physical properties suitable for the present invention.

Hereinafter, a method for manufacturing a polyethylene yarn for a skin cooling fabric of the present invention will be described in detail with reference to FIG. 1.

First, a chip-shaped polyethylene is injected into an extruder 100 and melted.

The polyethylene used as a raw material for the manufacture of the polyethylene yarn of the present invention has a density of 0.941 to 0.965 g/cm$^3$, a weight average molecular weight (Mw) of 50,000 to 99,000 g/mol, and a melt index (MI) (at 190° C.) of 6 to 21 g/10 min. In addition, taking into account that the polydispersity index may decrease during the spinning process, the polyethylene of the present invention used as a raw material has a polydispersity index (PDI) of 5.5 to 9 which is slightly higher than the target polydispersity index (i.e., the polydispersity index of yarn).

In order to manufacture a fabric that provides a high cooling sensation, the polyethylene yarn needs to have high crystallinity of 60 to 85%, and in order to manufacture a polyethylene yarn having such high crystallinity, it is desirable to use a high density polyethylene (HDPE) having a density of 0.941 to 0.965 g/cm$^3$.

When the weight average molecular weight (Mw) of polyethylene used as a raw material is less than 50,000 g/mol, the finally obtained polyethylene yarn is made difficult to express a strength of 4 g/d or more and a tensile modulus of 15 g/d or more, and as a result, pills may form on fabrics. On the contrary, when the weight average molecular weight (Mw) of the polyethylene exceeds 99,000 g/mol, the weavability of polyethylene yarn is not good due to the excessively high strength and tensile modulus, the stiffness is too high, and it is unsuitable for use in the manufacture of skin cooling fabrics that are intended for contacting with the user's skin.

When the polydispersity index (PDI) of polyethylene used as a raw material is less than 5.5, the flowability is poor due to the relatively narrow molecular weight distribution, and the processability during melt extrusion is deteriorated, which causes yarn breakage due to discharge unevenness during the spinning process. On the contrary, when the PDI of the HDPE exceeds 9, the melt flowability and the processability at the time of melt extrusion are improved due to the wide molecular weight distribution, but the low molecular weight polyethylene is excessively contained, so that it may be difficult for the the finally obtained polyethylene yarn to have strength of 4 g/d or more and a tensile modulus of 15 g/d or more, and as a result, pills may relatively easily form on fabrics.

When the melt index (MI) of polyethylene used as a raw material is less than 6 g/10 min, it is difficult to ensure smooth flowability in an extruder 100 due to the high viscosity and low flowability of the molten polyethylene, and the uniformity and processability of the extrudate are reduced, thus increasing the risk of yarn breakage during the spinning process. On the other hand, when the melt index (MI) of the polyethylene exceeds 21 g/10 min, the flowability in the extruder 100 becomes relatively good, but it may be difficult for the finally obtained polyethylene yarn to have a strength of greater than 4 g/d and a tensile modulus of 15 g/d or more.

Optionally, a fluorine-based polymer can be added to polyethylene.

As the method of adding the fluorine-based polymer, (i) a method of injecting a master batch containing polyethylene and a fluorine-based polymer together with a polyethylene chip into the extruder 100 and then melting them therein, or (ii) a method of injecting the fluorine-based polymer into an extruder 100 through a side feeder while injecting the polyethylene chip into the extruder 100, and then melting them together, may be mentioned.

By adding a fluorine-based polymer to the polyethylene, the occurrence of yarn breakage during the spinning process and the multistage stretching process can be further suppressed, and thus the productivity can be further improved. As a non-limiting example, the fluorine-based polymer added to the polyethylene may be a tetrafluoroethylene copolymer. The fluorine-based polymer may be added to the polyethylene in such amount that the content of fluorine in the finally produced yarn becomes 50 to 2500 ppm.

After the polyethylene having the above-described physical properties is injected into the extruder 100 and melted, the molten polyethylene is transferred to a spinneret 200 by a screw (not shown) in the extruder 100, and extruded through a plurality of spinning holes formed in the spinneret 200.

The number of holes in the spinneret 200 may be determined according to the DPF and the total fineness of the produced yarn. For example, when manufacturing a yarn having total fineness of 75 denier, the spinneret 200 may have 20 to 75 holes. Further, when manufacturing a yarn having total fineness of 450 denier, the spinneret 200 may have 90 to 450 holes, preferably 100 to 400 holes.

The melting step in the extruder 100 and the extrusion step through the spinneret 200 are preferably performed at 150 to 315° C., preferably 250 to 315° C., more preferably 265 to 310° C. That is, the extruder 100 and the spinneret 200 are preferably maintained at 150 to 315° C., preferably 250 to 315° C., more preferably 265 to 310° C.

When the spinning temperature is less than 150° C., the spinning temperature is low so that the HDPE may not be uniformly melted and thus spinning may be difficult. On the other hand, when the spinning temperature exceeds 315° C., the polyethylene may be thermally decomposed and it may be difficult to express the desired strength.

L/D, which is the ratio of the hole length L to the hole diameter D of the spinneret 200, may be 3 to 40. When L/D is less than 3, a die swell phenomenon occurs during melt extrusion, and it becomes difficult to control the elastic behavior of polyethylene, resulting in a poor spinning property. Further, when the L/D exceeds 40, a non-uniform discharge phenomenon may occur due to a pressure drop along with yarn breakage caused by a necking phenomenon of the molten polyethylene passing through the spinneret 200.

As the molten polyethylene is discharged from the holes of the spinneret 200, the solidification of the polyethylene is started by the difference between the spinning temperature and the ambient temperature, and simultaneously a semi-solidified filament is formed. In this specification, not only the semi-solidified filament but also the completely solidified filament are collectively referred to as "filament".

The plurality of filaments 11 are completely solidified by being cooled in a quenching zone 300. The cooling of the filaments 11 may be performed by an air cooling method.

In the quenching zone 300, the cooling of the filaments 11 is preferably performed so as to be cooled to 15 to 40° C. using cooling air having a wind speed of 0.2 to 1 m/s. When the cooling temperature is less than 15° C., the elongation may be insufficient due to over-cooling, which may cause yarn breakage in the drawing process. When the cooling temperature exceeds 40° C., the fineness deviation between filaments 11 increases due to non-uniform solidification which may cause yarn breakage in the drawing process.

Subsequently, the filaments 11 that are cooled and completely solidified are converged by a converging part 400 to form a multifilament 10.

As illustrated in FIG. 1, the method of the present invention may further include a step of applying an oil onto the cooled filaments 11 using an oil roller (OR) or oil jet, before forming the multifilament 10. The oil applying step may be performed through a metered oiling (MO) method.

Optionally, the step of forming the multifilament 10 through a converging part 400 and the oil applying step may be performed at the same time.

As illustrated in FIG. 1, the polyethylene yarn of the present invention may be produced via a direct spinning drawing (DSD) process. The multifilament 10 is directly transferred to a multistage drawing part 500 including a plurality of godet roller parts GR1 . . . GRn and multistage-drawn at a total draw ratio of 2.5 to 8.5, preferably 3.5 to 7.5, and then wound on a winder 600.

Alternatively, after the multifilament 10 is first wound as an undrawn yarn, the undrawn yarn can be drawn, thereby manufacturing the polyethylene yarn of the present invention. The polyethylene yarn of the present invention may be manufactured through a two-step process of first melt spinning polyethylene to produce an undrawn yarn and then drawing the undrawn yarn.

If the total draw ratio applied in the drawing process is less than 3.5, in particular, less than 2.5, (i) the finally obtained polyethylene yarn cannot have crystallinity of 60% or more, and thus the fabric made from the yarn cannot provide a user with a sufficient cooling sensation, and (ii) the polyethylene yarn cannot have strength of greater than 4 g/d, a tensile modulus of 15 g/d or more, and elongation at break of 55% or less, and as a result, pills may form on the fabric produced from the yarn.

On the other hand, when the total draw ratio is greater than 7.5, in particular, greater than 8.5, the finally obtained polyethylene yarn cannot have strength of 6 g/d or less, a tensile modulus of 80 g/d or less, and elongation at break of 14% or more. Therefore, not only is the weavability of the polyethylene yarn not good, but also the fabric produced using the yarn becomes excessively stiff, thus making the user feel discomfort.

If the linear velocity of the first godet roller part (GR1) that determines the spinning speed of the melt spinning of the present invention is determined, the linear velocity of the remaining godet roller parts is appropriately determined so that in the multistage drawing part 500, a total draw ratio of 2.5 to 8.5, preferably 3.5 to 7.5, can be applied to the multifilament 10.

According to one embodiment of the present invention, by appropriately setting the temperature of the godet roller parts (GR1 . . . GRn) of the multistage drawing part 500 in the range of 40 to 140° C., heat-setting of the polyethylene yarn may be performed through the multistage drawing part 500.

For example, the temperature of the first godet roller part (GR1) may be 40 to 80° C., and the temperature of the last godet roller part (GRn) may be 110 to 140° C. The temperature of each of the godet roller parts excluding the first and last godet roller parts (GR1, GRn) may be set to be equal to or higher than the temperature of the godet roller part immediately before. The temperature of the last godet roller part (GRn) may be set to be equal to or higher than the temperature of the godet roller part immediately before, but may be set slightly lower than that temperature.

Multi-stage drawing and heat setting of the multifilament 10 are carried out by the multistage drawing part 500 at the same time, and the multistage drawn multifilament 10 is wound around the winder 600, thereby completing the manufacture of the polyethylene yarn for a skin cooling fabric of the present invention.

Hereinafter, the present invention will be described in more detail by way concrete examples. However, these examples are only to aid the understanding of the present invention and the scope of the present invention is not limited thereto.

Example 1

A polyethylene yarn containing 200 filaments and having total fineness of 400 denier was produced using the apparatus illustrated in FIG. 1. In detail, a polyethylene chip having a density of 0.961 g/cm$^3$, a weight average molecular weight (Mw) of 87,660 g/mol, a polydispersity index (PDI) of 6.4, and a melt index (MI at 190° C.) of 11.9 g/10 min was injected into an extruder 100 and melted. The molten polyethylene was extruded through a spinneret 200 having 200 holes. L/D, which is the ratio of the hole length L to the hole diameter D of the spinneret 200, was 6. The spinneret temperature was 265° C.

The filaments 11 formed while being discharged from the spinneret 200 were finally cooled to 30° C. by cooling air having a wind speed of 0.45 m/s in a quenching zone 300, and were converged into a multifilament 10 by the converging unit 400 and moved to the multistage drawing part 500.

The multistage drawing part 500 was composed of a total of five stage godet rollers, the temperature of the godet roller parts was set to 70 to 115° C., and the temperature of the rear stage roller part was set to be equal to or higher than the temperature of the roller part immediately before.

After the multifilament 10 was drawn at a total draw ratio of 7.5 by the multistage drawing part 500, it was wound on a winder 600, thereby obtaining a polyethylene yarn.

Example 2

A polyethylene yarn was obtained in the same manner as in Example 1, except that a polyethylene chip having a density of 0.958 g/cm$^3$, a weight average molecular weight (Mw) of 98,290 g/mol, a polydispersity index (PDI) of 8.4, and a melt index (MI at 190° C.) of 6.1 g/10 min was used, and the spinneret temperature was 275° C.

Example 3

A polyethylene yarn was obtained in the same manner as in Example 1, except that a polyethylene chip having a density of 0.948 g/cm$^3$, a weight average molecular weight (Mw) of 78,620 g/mol, a polydispersity index (PDI) of 8.2, and a melt index (MI at 190° C.) of 15.5 g/10 min was used, the spinneret temperature was 255° C., and the total draw ratio was 6.8.

Comparative Example 1

A polyethylene yarn was obtained in the same manner as in Example 1, except that a polyethylene chip having a density of 0.962 g/cm$^3$, a weight average molecular weight (Mw) of 98,550 g/mol, a polydispersity index (PDI) of 4.9, and a melt index (MI at 190° C.) of 6.1 g/10 min was used, and the spinneret temperature was 285° C.

Comparative Example 2

A polyethylene yarn was obtained in the same manner as in Example 1, except that a polyethylene chip having a density of 0.961 g/cm$^3$, a weight average molecular weight (Mw) of 98,230 g/mol, a polydispersity index (PDI) of 7.0, and a melt index (MI at 190° C.) of 2.9 g/10 min was used, the spinneret temperature was 290° C., and the total draw ratio was 8.6.

Comparative Example 3

A polyethylene yarn was obtained in the same manner as in Example 1, except that a polyethylene chip having a density of 0.961 g/cm$^3$, a weight average molecular weight (Mw) of 180,550 g/mol, a polydispersity index (PDI) of 6.4, and a melt index (MI at 190° C.) of 0.6 g/10 min was used, the spinneret temperature was 300° C., it was drawn at a total draw ratio of 14 through the multistage drawing part 500 composed of a total of eight stage godet roller parts, and the temperature of the godet roller parts was set to 75 to 125° C.

Test Example 1

The strength-elongation properties, toughness, tensile strength, tensile modulus, elongation at break, crystallinity, and polydispersity index (PDI) of the polyethylene yarn prepared by each of Examples 1 to 3 and Comparative Examples 1 to 3 were measured as follows, and the results are shown in Table 1 and Table 2 below.

(1) Strength-Elongation Properties, Tensile Strength, Tensile Modulus, Elongation at Break and Toughness of Polyethylene Yarn The strength-elongation curves (x-axis:elongation, y-axis: strength) of the polyethylene yarns at ambient temperature were determined using an Instron universal tensile tester (Instron Engineering Corp., Canton, Mass.) in accordance with ASTM D885 (sample length: 250 mm, tensile speed: 300 mm/min, and initial load: 0.05 g/d).

"Elongation at strength of 1 g/d", "elongation at strength of 3 g/d", "difference between elongation at strength of 4 g/d and elongation at maximum strength", tensile strength, tensile modulus, and elongation at break of the polyethylene yarn were respectively determined from the strength-elongation curve. In addition, the toughness of the polyethylene yarn was determined by calculating the area between the strength-elongation curve (x-axis:elongation, y-axis: strength) and the x-axis through integration.

(2) Crystallization of Polyethylene Yarn

The crystallinity of the polyethylene yarn was measured using an XRD instrument (X-ray diffractometer) (manufacturer. PANalytical, model name:

EMPYREAN). In detail, the polyethylene yarn was cut to prepare a sample having a length of 2.5 cm. The sample was fixed to a sample holder and then measurement was performed under the following conditions.

Light source (X-ray source): Cu-Kα radiation
Power. 45 KV×25 mA
Mode: continuous scan mode
Scan angle range: 10° to 40°
Scan speed: 0.1°/s (3) Polydispersity Index (PDI) of Polyethylene Yarn After completely dissolving the polyethylene yarn in the following solvent, the weight average molecular weight (Mw) and the number average molecular weight (Mn) of the polyethylene were respectively determined using the following gel permeation chromatography (GPC), and then the ratio (Mw/Mn) of the weight average molecular weight (Mw) to the number average molecular weight (Mn) was calculated, thereby obtaining the polydispersity index (PDI) of the polyethylene yarn.

Analytical equipment: PL-GPC 220 system

Column: 2×PLGEL MIXED-B (7.5×300 mm)

Column temperature: 160° C.

Solvent: trichlorobenzene (TCB)+0.04 wt % dibutylhydroxytoluene (BHT) (after drying with 0.1% $CaCl_2$))

Dissolution condition: Measure the solution which passed through the glass filter (0.7 μm) after dissolution at 160° C. for 1 to 4 hours.

Injector, Detector temperature: 160° C.

Detector: RI Detector

Flow rate: 1.0 ml/min

Injection volume: 200 μl

Standard sample: polystyrene

TABLE 1

| | | Example 1 | Example 2 | Example 3 |
|---|---|---|---|---|
| PE | Density (g/cm$^3$) | 0.961 | 0.958 | 0.948 |
| | Mw (g/mol) | 87,660 | 98,290 | 78,620 |
| | PDI | 6.4 | 8.4 | 8.2 |
| | MI (g/10 min) | 11.9 | 6.1 | 15.5 |
| Spinneret temperature (° C.) | | 265 | 275 | 255 |
| | Total draw ratio | 7.5 | 7.5 | 6.8 |
| PE yarn | Elongation (%) @ 1 g/d | 1.75 | 1.92 | 1.45 |
| | Elongation (%) @ 3 g/d | 7.1 | 8.3 | 6.2 |
| | \|Elongation (%) @ 4 g/d − Elongation (%) @ maximum strength\| (%) | 15 | 12 | 9.5 |
| | Toughness (J/m$^3$) | 86 | 92 | 65 |
| | Tensile strength (g/d) | 4.6 | 5.3 | 4.3 |
| | Tensile modulus (g/d) | 49.6 | 56.3 | 42.6 |
| | Elongation at break (%) | 25 | 22 | 28 |
| | Crystallinity (%) | 72 | 74 | 71 |
| | PDI | 5.6 | 6.8 | 6.3 |

TABLE 2

| | | Comparative Example 1 | Comparative Example 2 | Comparative Example 3 |
|---|---|---|---|---|
| PE | Density (g/cm$^3$) | 0.962 | 0.961 | 0.961 |
| | Mw (g/mol) | 98,550 | 98,230 | 180,550 |
| | PDI | 4.9 | 7.0 | 6.4 |
| | MI (g/10 min) | 6.1 | 2.9 | 0.6 |
| Spinneret temperature (° C.) | | 285 | 290 | 300 |
| | Total draw ratio | 7.5 | 8.6 | 14 |
| PE yarn | Elongation (%) @ 1 g/d | 0.95 | 0.82 | 0.45 |
| | Elongation (%) @ 3 g/d | 4.4 | 4.8 | 1.52 |
| | \|Elongation (%) @ 4 g/d − Elongation (%) @ maximum strength\| (%) | 7.0 | 5.2 | 4.7 |
| | Toughness (J/m$^3$) | 52 | 50 | 72 |
| | Tensile strength (g/d) | 6.5 | 7.2 | 17.3 |
| | Tensile modulus (g/d) | 63.4 | 68.4 | 485 |
| | Elongation at break (%) | 13.5 | 11.8 | 6.6 |
| | Crystallinity (%) | 73 | 74 | 80 |
| | PDI | 3.3 | 4.9 | 4.4 |

Example 4

The plain weave was performed using the polyethylene yarn of Example 1 as a warp yarn and a weft yarn, thereby manufacturing a fabric having a warp density of 30 ea/inch and a weft density of 30 ea/inch.

Example 5

A fabric was manufactured in the same manner as in Example 4, except that the polyethylene yarn of Example 2 was used instead of the polyethylene yarn of Example 1.

Example 6

A fabric was manufactured in the same manner as in Example 4, except that the polyethylene yarn of Example 3 was used instead of the polyethylene yarn of Example 1.

Comparative Example 4

A fabric was manufactured in the same manner as in Example 4, except that the polyethylene yarn of Comparative Example 1 was used instead of the polyethylene yarn of Example 1.

Comparative Example 5

A fabric was manufactured in the same manner as in Example 4, except that the polyethylene yarn of Comparative Example 2 was used instead of the polyethylene yarn of Example 1.

Comparative Example 6

A fabric was manufactured in the same manner as in Example 4, except that the polyethylene yarn of Comparative Example 3 was used instead of the polyethylene yarn of Example 1.

Test Example 2

The contact cold sensation ($Q_{max}$), thermal conductivity (thickness direction), heat transfer coefficient (thickness direction), pilling resistance, abrasion resistance, and stiffness of the fabrics respectively manufactured by Examples 4 to 6 and Comparative Examples 4 to 6 were measured as follows, and the results are shown in Tables 3 and 4 below.

(1) Contact Cold Sensation ($Q_{max}$) of Fabrics

A fabric sample having a size of 20 cm×20 cm was prepared, and then allowed to stand for 24 hours under the conditions of a temperature of 20±2° C. and a RH of 65±2%. Then, the contact cold sensation ($Q_{max}$) of the fabric was measured using a KES-F7 THERMO LABO II (Kato Tech Co., LTD.) apparatus under the test environment of a temperature of 20±2° C. and 65±2% RH.

In detail, as illustrated in FIG. 2, the fabric sample 23 was placed on a base plate (also referred to as "Water-Box") 21 maintained at 20° C., and a T-Box 22a (contact area: 3 cm×3 cm) heated to 30° C. was placed on the fabric sample 23 for only 1 second. That is, the other surface of the fabric sample 23 whose one surface was in contact with the base plate 21 was brought into instantaneous contact with the T-Box 22a. The contact pressure applied to the fabric sample 23 by the T-Box 22a was 6 gf/cm$^3$. Then, the $Q_{max}$ value displayed on a monitor (not shown) connected to the apparatus was recorded. Such a test was repeated 10 times and the arithmetic mean value of the obtained $Q_{max}$ values was calculated.

(2) Thermal Conductivity and Heat Transfer Coefficient of Fabrics

A fabric sample having a size of 20 cm×20 cm was prepared and then allowed to stand for 24 hours under the conditions of a temperature of 20±2° C. and a RH of 65±2%. Then, the thermal conductivity and the heat transfer coefficient of the fabric were measured using a KES-F7 THERMO LABO II (Kato Tech Co., LTD.) apparatus under the test environment of a temperature of 20±2° C. and 65±2% RH.

In detail, as illustrated in FIG. 3, the fabric sample 23 was placed on a base plate 21 maintained at 20° C., and the T-Box 22b (contact area: 5 cm×5 cm) heated to 30° C. was placed on the fabric sample 23 for 1 minute. Even while the BT-Box 22b was in contact with the fabric sample 23, heat was continuously supplied to the BT-Box 22b so that the temperature could be maintained at 30° C. The amount of heat (i.e., heat flow loss) supplied to maintain the temperature of the BT-Box 22b was displayed on a monitor (not shown) connected to the apparatus. Such a test was repeated 5 times and the arithmetic mean value of the obtained heat flow loss was calculated. Then, the thermal conductivity and the heat transfer coefficient of the fabric were calculated using Equations 2 and 3 below.

$$K=(W*D)/(A*\Delta T) \quad \text{[Equation 2]}$$

$$K=K/D \quad \text{[Equation 3]}$$

where K is a thermal conductivity (W/cm ° C.), D is a thickness (cm) of the fabric sample 23, A is a contact area (=25 $cm^3$) of the BT-Box 22b, ΔT is a temperature difference (=10° C.) on both sides of the fabric sample 23, W is a heat flow loss (Watt), and k is a heat transfer coefficient ($W/cm^3$. ° C.).

(3) Stiffness of Fabric

The stiffness of the fabric was measured by the circular bend method using a stiffness measuring device in accordance with ASTM D 4032. As the stiffness (kgf) is lower, the fabric has softer properties.

(4) Pilling Resistance of Fabrics

The pilling resistance of the fabric was measured using a Martindale tester in accordance with ASTM D 4970-07 (friction movement frequency: total of 200 times). The pilling resistance grade criteria are as follows.

Grade 1: Very severe pilling
Grade 2: Severe pilling
Grade 3: Moderate pilling
Grade 4: Slight pilling
Grade 5: No pilling (5) Abrasion Resistance of abrics The abrasion resistance of the fabric was measured using a Martindale tester in accordance with the Martindale method as specified in KS K ISO 12947-2:2014. In detail, the number of cycles until two yarns in the fabric were broken was measured.

TABLE 3

| | Example 4 | Example 5 | Example 6 |
|---|---|---|---|
| $Q_{max}$ ($W/cm^2$) | 0.159 | 0.167 | 0.149 |
| Thermal conductivity (W/cm · ° C.) | 0.00043 | 0.00048 | 0.00039 |
| Heat transfer coefficient ($W/cm^2$ · ° C.) | 0.0126 | 0.0142 | 0.0123 |
| Stiffness (kgf) | 0.45 | 0.52 | 0.43 |
| Pilling resistance (grade) | 4 | 4 | 4 |
| Abrasion resistance (cycles) | 6530 | 7560 | 5280 |

TABLE 4

| | Comparative Example 4 | Comparative Example 5 | Comparative Example 6 |
|---|---|---|---|
| $Q_{max}$ ($W/cm^2$) | 0.166 | 0.167 | 0.168 |
| Thermal conductivity (W/cm · ° C.) | 0.00053 | 0.00058 | 0.00062 |
| Heat transfer coefficient ($W/cm^2$ · ° C.) | 0.00147 | 0.00149 | 0.00153 |
| Stiffness (kgf) | 0.65 | 0.72 | 0.95 |
| Pilling resistance (grade) | 3 | 3 | 4 |
| Abrasion resistance (cycles) | 4510 | 4730 | 18540 |

[Explanation of Symbols]

| | |
|---|---|
| 100: extruder | 200: spinneret |
| 300: quenching zone | 11: filaments |
| OR: oil roller | 400: converging part |
| 10: multifilament | 500: multistage drawing part |
| GR1: first godet roller part | GRn: last godet roller part |
| 600: winder | 21: base plate |
| 22a: T-Box | 22b: BT-Box |
| 23: fabric sample | |

The invention claimed is:

1. A polyethylene yarn, wherein in a strength-elongation curve of the polyethylene yarn obtained by measuring at ambient temperature, (i) elongation at strength of 1 g/d is 1 to 3%, (ii) elongation at strength of 3 g/d is 6 to 10%, and (iii) a difference between elongation at strength of 4 g/d and elongation at maximum strength is 9 to 25%, and the polyethylene yarn has toughness of 55 to 120 $J/cm^3$ at ambient temperature, wherein the polyethylene var includes a polyethylene polymer having a weight average molecular weight (Mw) of 50,000 to 99,000 g/mol, a polydispersity index (PDI) of 5.5 to 9, and a melt index (MD) of 6 to 21 g/10 min at 190° C.

2. The polyethylene yarn of claim 1, wherein the polyethylene yarn has tensile strength of more than 4 g/d and 6 g/d or less, a tensile modulus of 15 to 80 g/d, elongation at break of 14 to 55%, and crystallinity of 60 to 85%.

3. The polyethylene yarn of claim 1, wherein the polyethylene yarn has a polydispersity index (PDI) of 5.5 to 7.0.

4. The polyethylene yarn of claim 1, wherein the polyethylene yarn has total fineness of 75 to 450 denier, and the polyethylene yarn includes a plurality of filaments each having fineness of 1 to 5 denier.

5. The polyethylene yarn of claim 1, wherein the polyethylene yarn has a circular cross-section.

6. A skin cooling fabric formed of the polyethylene yarn of claim 1, wherein the polyethylene var includes a polyethylene polymer having a weight average molecular weight (Mw) of 50,000 to 99,000 g/mol, a polydispersity index (PDI) of 5.5 to 9, and a melt index (MD) of 6 to 21 g/10 min at 190° C., wherein the skin cooling fabric at 20° C. has thermal conductivity in the thickness direction of 0.0003 to 0.0005 W/cm ° C., a heat transfer coefficient in the thickness direction of 0.01 to 0.02 $W/cm^{2}$° C., and a contact cold sensation ($Q_{max}$) of 0.1 $W/cm^2$ or more.

7. The skin cooling fabric of claim 6, wherein a pilling resistance of the skin cooling fabric measured according to ASTM D 4970-07 is grade 4 or higher, and abrasion resistance of the skin cooling fabric measured according to the Martindale method as specified in KS K ISO 12947-2:2014 is 5000 cycles or more.

8. The skin cooling fabric of claim 6, wherein an area density of the skin cooling fabric is 75 to 800 $g/m^2$.

* * * * *